US005352134A

United States Patent [19]

Jacobsen et al.

[11] Patent Number: 5,352,134

[45] Date of Patent: Oct. 4, 1994

[54] RF SHIELDED COAXIAL CABLE CONNECTOR

[75] Inventors: Ingolf G. Jacobsen, Phoenix, Ariz.; Claus K. Jorgensen, Vordingborg, Denmark

[73] Assignee: Cabel-Con, Inc., Phoenix, Ariz.

[21] Appl. No.: 80,343

[22] Filed: Jun. 21, 1993

[51] Int. Cl.[5] ..... H01R 9/05

[52] U.S. Cl. ..... 439/584; 439/583

[58] Field of Search ..... 439/578–585, 439/675, 271

[56] References Cited

U.S. PATENT DOCUMENTS

| | | | |
|---|---|---|---|
| 3,526,871 | 9/1970 | Hobart | 339/177 |
| 3,671,926 | 6/1972 | Nepovim | 339/177 E |
| 3,686,623 | 8/1972 | Nijman | 339/177 E |
| 3,706,958 | 12/1972 | Blanchenot | 339/177 E |
| 3,846,738 | 11/1974 | Nepovim | 339/177 R |
| 3,847,463 | 11/1974 | Hayward et al. | 339/8 P |
| 3,854,789 | 12/1974 | Kaplan | 439/584 |
| 4,346,958 | 8/1982 | Blanchard | 339/177 R |
| 4,441,781 | 4/1984 | Forney et al. | 339/177 R |
| 4,447,107 | 5/1984 | Major, Jr. | 339/171 E |
| 4,557,546 | 12/1985 | Dreyer | 339/177 R |
| 4,575,274 | 3/1986 | Hayward | 403/2 |
| 4,583,811 | 4/1986 | McMills | 339/177 R |
| 4,676,577 | 6/1987 | Szegda | 439/584 |
| 4,690,481 | 9/1987 | Randolph | 439/585 |
| 4,696,532 | 9/1987 | Mattis | 439/863 |
| 4,746,305 | 5/1988 | Nomura | 439/319 |
| 4,854,893 | 8/1989 | Morris | 439/578 |

*Primary Examiner*—David L. Pirlot

*Attorney, Agent, or Firm*—Cahill, Sutton & Thomas

[57] ABSTRACT

A two part coaxial cable connector includes a rear nut body housing a two step ferrule for gripping the sheath of a coaxial cable and a front nut body for gripping the conductor upon threaded engagement of the rear and front nut bodies. A mandrel, located within and protected by the rear nut body, slides within the sheath upon feeding of the cable into the rear nut body. A pair of annular inclined ramps formed in a ferrule encircling sleeve compress the ferrule to squeeze the ferrule into gripping engagement with the sheath while forcing ferrule rearwardly. A brass ring disposed between the ferrule and the end of the rear nut, which ring is compressed upon rearward movement of the ferrule and becomes amalgamated with the sleeve and ferrule to prevent spurious RF radiation from the rear nut body. Simultaneously, a collet in the front nut body is compressed to grip the conductor. To facilitate the feeding of a seamed or off round sheath, the ferrule, mandrel and associated parts float within the rear nut body. A positive visually apparent physical interference between the rear and front nut bodies prevents overtightening and resulting damage.

22 Claims, 2 Drawing Sheets

1/2

RF SHIELDED COAXIAL CABLE CONNECTOR

BACKGROUND OF THE INVENTION

1. Field of the Invention

The present invention relates to coaxial cable connectors and, more particularly, to a two part connector having a double lock action floating ferrule and enclosed mandrel.

2. Description of Related Art

Coaxial cables with which the present invention is used include a solid conductor of approximately one eighth inch diameter surrounded by a plastic or other non-rigid dielectric compound and encased within an electrically conducting generally metallic sheath of approximately one half inch diameter. Each end of such a coaxial cable is terminated by a connector which serves the functions of electrically engaging the conductor to transmit signals therethrough and of gripping the sheath to physically secure the cable and prevent detachment during normal operation. Preferably, the sheath should be gripped firmly but without damage to preserve the integrity and strength provided by the sheath. The connector must also serve as a shield to prevent spurious RF radiation.

SUMMARY OF THE INVENTION

The present invention is directed to a two part connector for terminating the end of a coaxial cable. A split two step ferrule for gripping the sheath of the cable is floatingly mounted between a brass ring and a sleeve having annular ramps for exerting radially compressive forces upon the center and one end of the ferrule. Upon tightening the sleeve, the resulting amalgamation of the sleeve, ferrule and brass ring serve as shields to prevent spurious RF radiation. A mandrel extends within the ferrule from the sleeve for supporting the interior cylindrical surface of the sheath upon compression of the ferrule. A collet for receiving and gripping the conductor is mounted within a cone of a seizing insulator, which insulator compresses the collet upon mating of the two parts of the connector. Upon assembly of the connector, a shroud of one part of the connector mates with an annular shoulder of the other part to mechanically prevent overtightening and simultaneously provides a visual indication that the two parts have been secured to one another.

It is a primary object of the present invention to provide a coaxial cable connector which prevents spurious RF radiation.

Another object of the present invention is to provide a floating two step ferrule assembly in a coaxial cable connector to accommodate cylindrical, seamed and non-cylindrical sheaths of a coaxial cable.

Yet another object of the present invention is to provide a sleeve for compressing the center and one end of a cable sheath engaging ferrule of a two part coaxial cable connector.

Still another object of the present invention is to provide an amalgamated sleeve and ferrule in a two part coaxial cable connector.

A further object of the present invention is to provide a brass ring for preventing spurious RF radiation from a two-part coaxial cable connector.

A still further object of the present invention is to provide a two-part coaxial cable connector having an RF shielding cable sheath engaging and retaining apparatus mounted in one part of the connector and conductor engaging and retaining apparatus mounted in the other part of the connector.

A yet further object of the present invention is to provide a method for terminating an end of a coaxial cable with a connector.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figures 1, 2, 5:
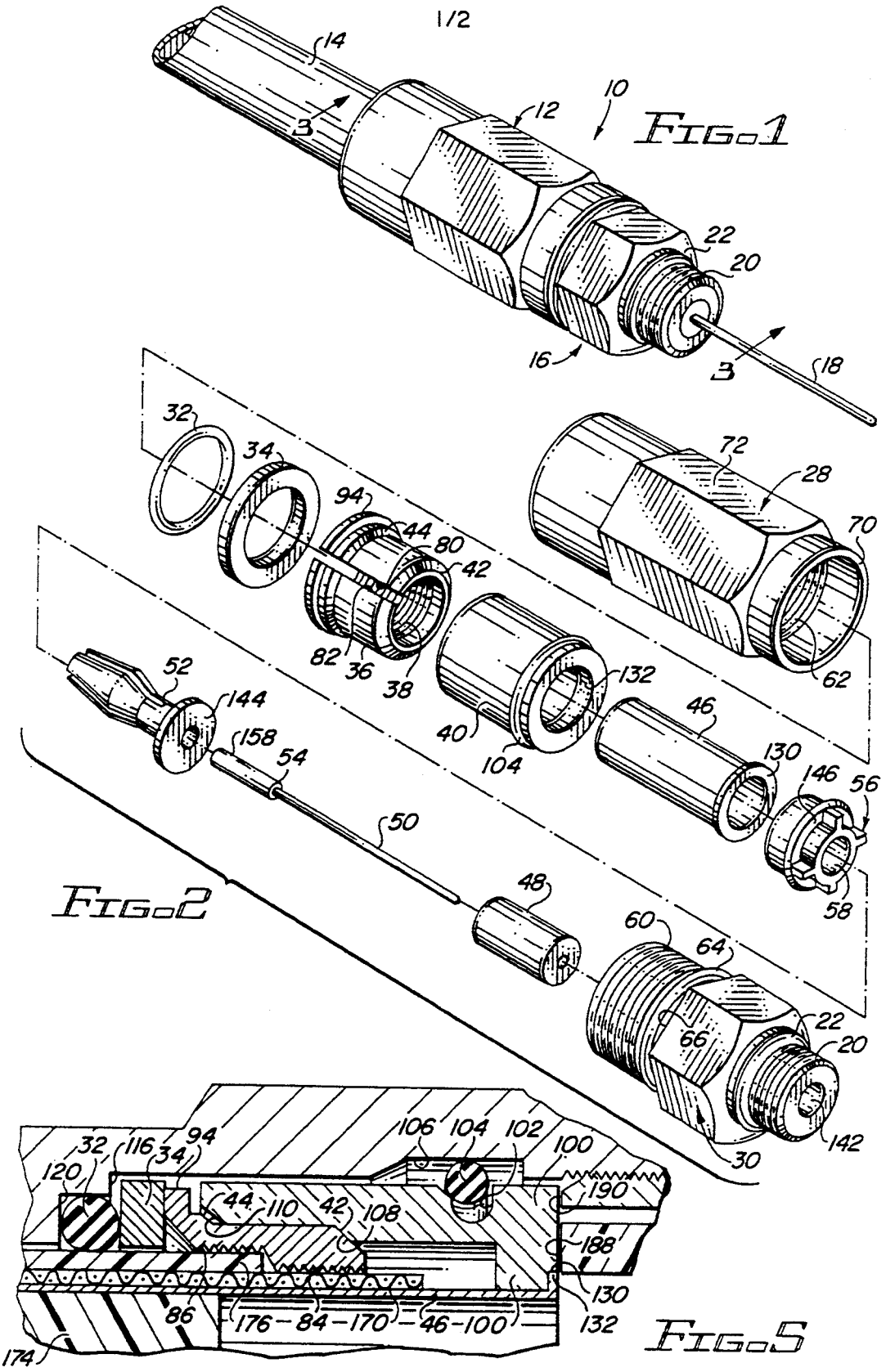
FIG. 1 is an isometric view of an assembled two-part coaxial cable connector constructed in accordance with the present invention.
FIG. 2 is an exploded view of the major components associated with each part of a two-part coaxial cable connector.
FIG. 5 is a partial cross sectional view taken within dashed line 5, as illustrated in FIG. 4.

Referring to FIG. 1, there is illustrated a two-part coaxial cable connector 10 in an assembled state. The connector includes a rear nut body 12 for receiving and terminating an end of a coaxial cable 14. Such cable may be of the type used for transmitting television signals (cable TV). Cable of this type includes a solid conductor of approximately one eighth inch diameter concentrically located within a metallic electrically conducting sheath of approximately one half inch diameter. A plastic or other dielectric non-rigid compound locates and maintains the conductor concentric with the sheath. A front nut body 16 mechanically and electrically engages the conductor of the cable and provides an electrical connection with an electrode, such as extending pin 18. The pin is penetrably insertable within a suitable coaxial receiver, socket or female end. The front nut body may include a threaded stud 20 for engaging a threaded cavity to mechanically secure connector 10 with the receiver of pin 18. O-ring 22 may be used to provide a weather and dust seal.

The upper part of FIG. 2 illustrates in exploded view of the major components located within housing 28 of rear nut body 12. The lower part of FIG. 2 illustrates the major components located within housing 30 of front nut body 16. With regard to rear nut body 12, an O-ring 32 circumscribingly engages the sheath of a cable inserted within rear nut body 12 to provide a weather seal between housing 28 and the cable. A brass ring 34 bears against O-ring 32 to establish the seal. The brass ring also serves as a shield to prevent spurious RF radiation from within the rear nut body and the cable.

Ferrule 36 is split to permit its compression to exert a gripping force upon the sheath of the cable. A plurality of inwardly radially oriented ridges 38 are disposed within the ferrule to assist in frictionally gripping the sheath. A sleeve 40 exerts radially compressive force upon ramps 42,44 of ferrule 36 to assist in having the ferrule frictionally grip the sheath of the cable. In addition, a mandrel 46 supported from the front end of sleeve 40 is inserted within the sheath of the cable to provide an anvil against which the sheath is compressed by the ferrule.

With regard to front nut body 16, a cylindrical insulator 48 is lodged within housing 30 to mechanically support pin 50 which extends from front nut body 16. A collet 52 of dielectric material is mounted upon split end 54 of pin 50. A seizing insulator 56 includes a coned surface 58 for engaging and compressing or constricting collet 52 upon translatory movement of the seizing insulator toward the collet.

Housing 16 of front nut body 16 includes a hollow threaded stud 60 for threadedly receiving internally threaded shroud 62 of housing 20 of rear nut body 12. An O-ring 64 is disposed at the base of stud 60 to engage the terminal end of the shroud and upon such engagement to provide a weather seal. A shoulder 66, formed as part of housing 30, creates a mechanical interference with edge 70 of shroud 62 upon assembly of the two parts of the connector to prevent further tightening and potential damage to the inner components or the terminal end of the gripped cable. Housing 28 includes a nut 72 to assist in threadedly engaging and disengaging the rear nut body 12 with front nut body 16.

The assembled components of rear nut body 12 and front nut body 16 will be described with primary reference to FIGS. 2, 3 and 5. Ferrule 36, which is split as defined by longitudinal edges 80,82 illustrated in FIG. 2, includes two sets of annular ridges 84,86. Set of ridges 84 define a smaller internal diameter than set of ridges 86. Terminal end 88 includes radially expanding ramp 42. Terminal end 92 of the ferrule includes a radially expanded shoulder 94 and radially expanding ramp 44. Sleeve 40 includes a radially inwardly extending shoulder 100 for supporting mandrel 46, which mandrel penetrably engages the inner surface of the aluminum cylindrical sheath 108 of cable 14. An annular groove 102 is disposed in the cylindrical surface of the sleeve to receive and retain a snap ring 104. The snap ring, upon expansion, engages internal groove 106 of housing 28 to prevent dislodgement of sleeve 40 from within the housing. As a result of the width of groove 106, sleeve 40 may be axially translated within the housing to a limited degree. An internal ramp 108 in the sleeve is configured to bear against ramp 42 of the ferrule and a further ramp 110 in the sleeve and disposed at terminal end 112 of the sleeve is configured to bear against ramp 44 of the ferrule. Brass ring 34 is disposed in adjacent relationship with shoulder 94 of the ferrule to limit movement of the ferrule in the direction of the brass ring. A shoulder 116 within housing 28 limits axial translation of the brass ring in that direction. O-ring 32, circumscribingly engaging cable 14, is lodged within annular recess 120 and adjacent brass ring 34. The O-ring becomes compressed between the brass ring and the annular recess to provide a weather seal about cable 14 to prevent intrusion of water and other foreign matter into rear nut body 112.

Figure 3:
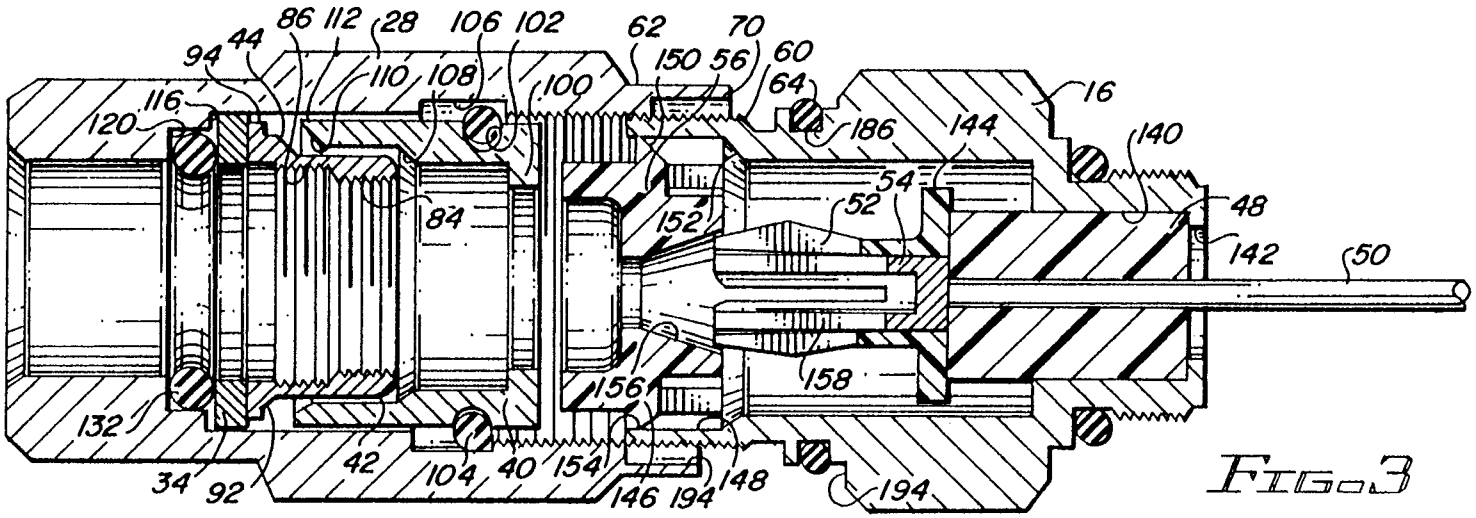
FIG. 3 is a cross sectional view taken along lines 3—3, as shown in FIG. 1, of the two parts of a two-part coaxial cable connector prior to final assembly.

It will be noted that, as particularly shown in FIG. 3, a degree of clearance exists between ferrule 36, sleeve 40 and housing 28. With such clearance, the ferrule floats within the housing, by which term is meant that the ferrule is free to a limited degree to move longitudinally, laterally and angularly with respect to the longitudinal axis of rear nut body 12. Such limited freedom of movement permit the ferrule to accommodate receiving a seamed sheath of cable 14, a somewhat distorted or deformed sheath of the cable or a non circular sheath of the cable. Such latitude is of significant importance for installation of cable connector 10 in the field.

Mandrel 46, as particularly shown in FIGS. 2 and 5, includes a radially expanded flange 130 and sleeve 40 includes an annular depression 132 for receiving the flange. Preferably, the flange is friction fitted or otherwise mechanically secured within the depression to maintain the mandrel fixedly attached to the sleeve. Upon insertion of cable 14 into the cable connector, mandrel 46 is slid interior of and adjacent to the sheath of the cable feed into the rear nut body to serve in the manner of an anvil against which ferrule 36 can be compressed by sleeve 40. It may be noted by inspection that all of mandrel 46 is located within housing 28, which location permits the housing to serve as a protective barrier to prevent damage or distortion to the mandrel during handling of the rear nut body.

Figure 4:
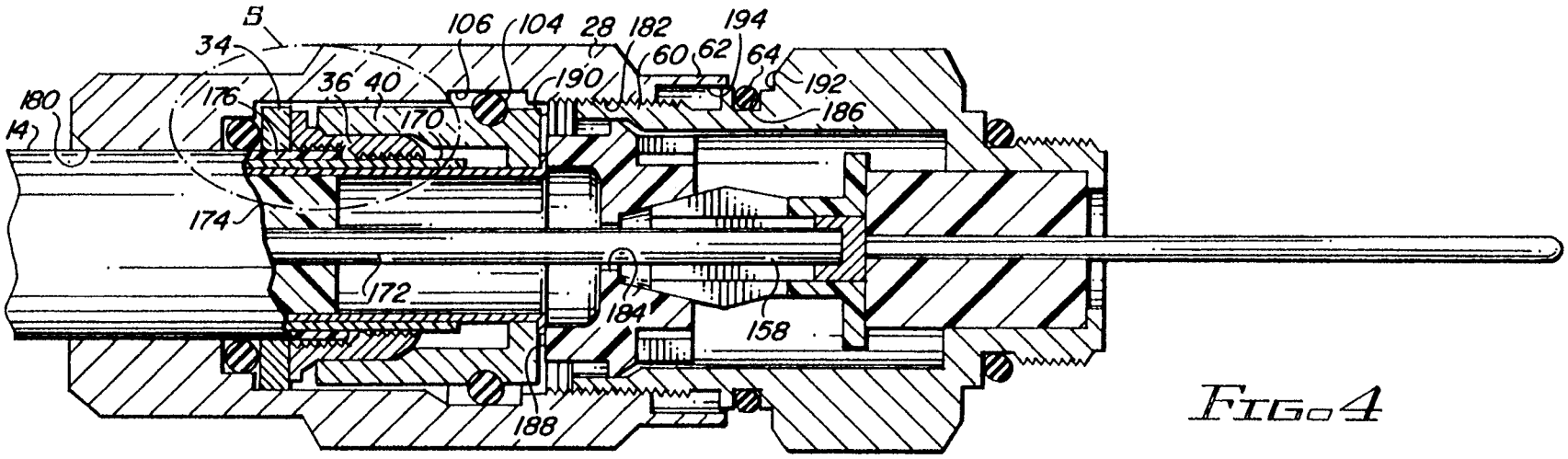
FIG. 4 is a cross sectional view of the two parts of a two-part coaxial cable connector in an assembled state.

As shown in FIG. 4, insulator 48 is disposed within circular cavity 140 of housing 30 of front nut body 16. Pin 50, penetrably mounted within insulator 48, extends from the front nut body through aperture 142. Collet 52, mounted upon split end 54, includes a circular flange 144 to bear against the corresponding end of insulator 48. Seizing insulator 56 includes a compressible annular protrusion 146. Housing 30 includes an expanded annular cavity 148 having shoulders 150,152. Annular cavity 148 is diametrically sized to permit translatory movement of seizing insulator 56 along the longitudinal axis of front nut body 16 while shoulder 150 limits movement of the seizing insulator in a direction away from collet 52. Seizing insulator 56 is snap fitted within annular cavity 148 by momentarily forcing the flexible and compressible protrusion 146 past passageway 154, which passageway is defined by shoulder 150 and end 190 of the housing. Cone 156 of the seizing insulator bears against commensurately angled surfaces of collet 52. Upon translatory motion of the seizing insulator toward collet 52 urged by shoulder 100 bearing against the seizing insulator, cone 156 will exert radially inwardly directed forces upon the collet to compress or constrict the collet. Compression of the collet will result in commensurate radially inward movement of fingers 158 of split end 54. After insertion of conductor 172 within the split end, radial inward movement of fingers 158 will grip and frictionally retain the conductor of cable 14 to provide a good electrical contact therewith and a friction fit therebetween.

Prior to attachment of a coaxial cable with cable connector 10, the end of the cable must be dressed. Such dressing includes cutting back of sheath 170 to expose a predetermined length of conductor 172 (see FIGS. 4 and 5). Additionally, dielectric compound 174, used to physically retain the conductor concentric with the sheath and to maintain the two electrically insulated from one another, is removed for a distance along the cable at least equivalent to the length of mandrel 46. A cylindrical covering 176 is dressed back to expose sheath 170 to the extent that set of ridges 84 coincide with the sheath and set of ridges 86 coincide with the covering.

The dressed end of cable 14, as illustrated in FIGS. 4 and 5, is feed through inlet 180 of housing 28 to circumscribingly receive mandrel 46 simultaneous with insertion within ferrule 36. Any distortion of the sheath or non circular cross-section of the sheath, as well as any seam of the sheath, will be readily accommodated by the ferrule due to its floating relationship within housing 28. After the dressed end of cable 14 has been fed into rear nut body 12, front nut body 16 is attached to the rear nut body. Threaded stud 60 of front nut body 16 is penetrably inserted within shroud 62 into threaded engagement with threads 182. Simultaneously, conductor 172 is penetrably inserted through aperture 184 of seizing insulator 56 and into the cavity defined by fingers 158 of split end 54. The insertion of the conductor is visually apparent to a user upon mating of the front and rear nut bodies. Shroud 62 circumscribingly the engages and compresses O-ring 64 located in annular slot 186 to form a weather tight seal. End 188 of seizing insulator 56 bears against shoulder 100 of sleeve 40 to force cone 156 of the seizing insulator forwardly to squeeze the collet about fingers 158 of split end 54. Moreover, end 190 of stud 60 bears against shoulder 100 to force axial translatory movement of sleeve 40 into operative relationship with ferrule 36.

Upon further threaded engagement between rear nut body 12 and front nut body 16, several events occur simultaneously. End 190 of front nut body 16 will bear against shoulder 100 of sleeve 28 to cause axial translatory movement of the sleeve onto ferrule 36. Upon interference between ramps 108,110 of the sleeve with ramps 42,44 of the ferrule, the ferrule will be forced toward brass ring 114 to force the brass ring against shoulder 116. Thereafter, the sleeve will continue to translate axially onto the ferrule with ramps 108,110 of the sleeve forcing radial contraction of the ferrule, which radial contraction is accommodated by the split of the ferrule with longitudinal edges 80,82 thereof being brought toward one another as the circumference of the ferrule is reduced. Simultaneously, set of ridges 84 will engage and become embedded in sheath 170 of cable 14. Furthermore, set of ridges 86 will engage and become embedded in covering 176 of the cable. The further the sleeve rides over the ferrule, the greater will be the compressive force exerted upon the ferrule. Both the sleeve and the ferrule are of aluminum and the compressive forces existing therebetween will tend to cause an amalgamation of the sleeve and the ferrule which will essentially eliminate any longitudinally oriented space therebetween through which spurious RF radiation may flow. Furthermore, significant compressive forces will be exerted upon brass ring 114 by shoulder 94 of ferrule 36 to compress and deform the brass ring into tight conforming contact with shoulder 116 of threaded shroud 62 and the circumference of cable 14. The resulting lack of any longitudinally oriented space or cavity between inlet 180 of rear nut body 12 and cable 14 will eliminate the possibility of any spurious radiation of RF energy from within cable connector 10. Translation of sleeve 40 with respect to ferrule 36 will continue until edge 70 of rear nut body 12 engages shoulder 192 of front nut body 16.

Threaded shroud 62 includes an annular depression 194 for receiving O-ring 64 lodged in annular cavity 186 of the front body. Upon engagement of the annular depression with the O-ring, a weather seal is formed at the junction between the front and rear nut bodies. Moreover, appropriate tightening of the front and rear nut bodies with one another is provided by visually inspecting the junction therebetween to ensure that edge 70 is in engagement with shoulder 192. Thus, such engagement and visual indication will prevent overtightening by providing a mechanical stop and yet assure adequate tightening to achieve amalgamation between sleeve 40, ferrule 36 and brass ring 34.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A coaxial cable connector having two threadedly engagable parts for terminating an end of a coaxial cable having a sheath and a conductor, said connector comprising in combination:

a) a first part comprising a rear nut body having an inlet for receiving and gripping the sheath of the coaxial cable said nut body including:
   1) a ferrule disposed within said rear nut body for at least partially circumscribing the sheath, said ferrule including means for floating said ferrule relative to said rear nut body upon engaging the cable with said rear nut body, said ferrule including a first ramp means disposed about the central part of said ferrule and a second ramp means disposed about an end of said ferrule;
   2) a sleeve having third and fourth ramp means for engaging said first and second ramp means, respectively, to radially inwardly compress at least the center and one end of said ferrule;
   3) a mandrel for penetrating the cable adjacent the inner surface of the sheath in juxtaposed relationship with said ferrule;

b) a second part comprising a front nut body for receiving and gripping the conductor of the coaxial cable, said front nut body including:
   1) an electrode;
   2) means for interconnecting the conductor with said electrode;

c) means for translating said sleeve along said ferrule to urge said third and fourth ramp means into engagement with said first and second ramp means, respectively, to compress said ferrule and to urge amalgamation between said sleeve and said ferrule to eliminate a pathway for spurious RF radiation;

d) a deformable ring disposed at said inlet and subject to compressive forces exerted by said ferrule for deforming into conforming configuration with said inlet and the cable to eliminate a pathway for spurious RF radiation through said inlet; and e) visually perceivable means for limiting the extent of threaded engagement between said rear nut body and said front nut body.

2. The connector as set forth in claim 1 wherein said sleeve and said ferrule are of aluminum.

3. The connector as set forth in claim 2 wherein said ring is of brass.

4. The connector as set forth in claim 1 including means for retaining said sleeve, said ferrule and said ring within said rear nut body.

5. The connector as set forth in claim 4 wherein said rear nut body includes an internal groove and said sleeve includes an annular groove and wherein said retaining means comprises a snap ring engaging the internal groove and the annular groove for locking engagement between said rear nut body and said sleeve.

6. The connector as set forth in claim 5 including means for securing said mandrel with said sleeve to positionally support said mandrel interior of said ferrule.

7. The connector as set forth in claim 6 wherein said mandrel is wholly contained within said rear nut body.

8. The connector as set forth in claim 1 including means for retaining said ring, said ferrule, said sleeve and said mandrel within said rear nut body.

9. The connector as set forth in claim 8 wherein said retaining means comprises a snap ring.

10. The connector as set forth in claim 1 wherein said interconnecting means comprises a collet for imposing a gripping force upon the conductor and a seizing insulator for constricting said collet.

11. The connector as set forth in claim 10 including means for translating said seizing insulator along the longitudinal axis of said connector in response to threaded engagement of said first part with said second part to constrict said collet.

12. The connector as set forth in claim 11 wherein said electrode includes a split end for receiving the conductor and wherein said split end is insertable within said collet.

13. The connector as set forth in claim 12 wherein said electrode comprises a pin extending from said front nut body.

14. The connector as set forth in claim 10 wherein said seizing insulator includes an aperture for penetrably receiving the conductor.

15. The connector as set forth in claim 14 wherein penetration of the conductor into the aperture of said seizing insulator is visually perceivable upon assembly of said first and second parts.

16. The connector as set forth in claim 1 wherein said ferrule is longitudinally, laterally and angularly repositionable within rear nut body prior to feeding of the coaxial cable into said first part.

17. A method for terminating a dressed end of a coaxial cable having a sheath and a conductor with a coaxial cable connector having a rear nut body threadedly engagable with a front nut body, said method comprising the steps of:

a) feeding the dressed end into the rear nut body and through a cable circumscribing ring and a floating ferrule retained within the rear nut body;
b) axially realigning the ferrule during said step of feeding to facilitate penetrating engagement by the cable sheath;
c) inserting in circumscribed relationship a mandrel located in the rear nut body within the sheath in juxtaposed relationship with the ferrule during exercise of said step of feeding;
d) threadedly engaging the rear nut body with the front nut body;
e) locating the conductor within a collet in the front nut body prior to said step of threadedly engaging;
f) radially inwardly compressing with a sleeve a central part and an end of the ferrule to grip the sheath during exercise of said step of threadedly engaging;
g) constricting the collet to grip the conductor;
h) amalgamating the sleeve, the ferrule and the ring during said step of threadedly engaging to prevent spurious RF radiation from the rear nut body; and
i) limiting with a mechanical stop the extent of threaded engagement between the rear nut body and the front nut body.

18. The method as set forth in claim 17 wherein said step of compressing includes the step of urging movement of ramps of the sleeve against corresponding ramps of the ferrule.

19. The method as set forth in claim 17 wherein said step of realigning includes the step of floating the ferrule within the rear nut body upon exercise of said step of feeding.

20. The method as set forth in claim 17 wherein said step of compressing includes the step of providing a visual indication of penetration of the conductor into the collet upon exercise of said step of locating.

21. The method as set forth in claim 17 wherein said step of compressing includes the step of maintaining the mandrel within the rear nut body prior to and subsequent to exercise of said steps of inserting and realigning.

22. The method as set forth in claim 17 wherein said steps of compressing and constricting are exercised during said step of threadedly engaging.

* * * * *